US010903569B2

(12) United States Patent
Boutayeb

(10) Patent No.: US 10,903,569 B2
(45) Date of Patent: Jan. 26, 2021

(54) RECONFIGURABLE RADIAL WAVEGUIDES WITH SWITCHABLE ARTIFICIAL MAGNETIC CONDUCTORS

(71) Applicant: Halim Boutayeb, Ottawa (CA)

(72) Inventor: Halim Boutayeb, Ottawa (CA)

(73) Assignee: Huawei Technologies Co., Ltd., Shenzhen (CN)

( * ) Notice: Subject to any disclaimer, the term of this patent is extended or adjusted under 35 U.S.C. 154(b) by 407 days.

(21) Appl. No.: 16/009,980

(22) Filed: Jun. 15, 2018

(65) Prior Publication Data

US 2019/0386392 A1 Dec. 19, 2019

(51) Int. Cl.
*H01Q 3/44* (2006.01)
*H01F 7/20* (2006.01)
*H01Q 13/20* (2006.01)

(52) U.S. Cl.
CPC ..... *H01Q 3/44* (2013.01); *H01F 7/20* (2013.01); *H01Q 13/20* (2013.01)

(58) Field of Classification Search
CPC .. H01Q 3/44; H01Q 3/40; H01Q 3/26; H01Q 1/246; H01Q 13/20; H01Q 25/00; H01Q 25/02; H01F 7/20
USPC ..... 342/373
See application file for complete search history.

(56) References Cited

U.S. PATENT DOCUMENTS 6,917,343 B2 7/2005 Sanchez et al.
7,679,563 B2 3/2010 Werner et al.
8,451,189 B1 5/2013 Fluhler
9,397,395 B2 7/2016 Boutayeb
9,692,126 B2 * 6/2017 Sharawi ..... H01Q 21/065
9,705,611 B1 7/2017 West
2004/0263420 A1 12/2004 Werner et al.
2009/0146894 A1 * 6/2009 Drexler ..... H01Q 9/0407 343/757
2012/0256811 A1 10/2012 Colburn et al.
2015/0380814 A1 12/2015 Boutayeb et al.
2015/0380815 A1 12/2015 Boutayeb et al.
2016/0064825 A1 * 3/2016 Ng ..... H01Q 1/27 343/713

OTHER PUBLICATIONS

High-Impedance Electromagnetic Surfaces with a Forbidden Frequency Band, Dan Sievenpiper et al., IEEE Transactions on Microwave Theory and Techniques, vol. 47, No. 11, Nov. 1999, pp. 2059-2074.

(Continued)

*Primary Examiner* — Harry K Liu

(57) ABSTRACT

A switchable artificial magnetic conductor (S-AMC) element that includes a conductive layer, a conductive patch located on one side of the conductive layer and electrically isolated from the conductive layer, and an open stub located on an opposite side of the conductive layer and electrically isolated from the conductive layer. A switch element is configured to selectively open and close an electrical connection between the conductive patch and the open stub in response to a control signal. When the electrical connection is closed the conductive patch presents a high impedance, magnetically conductive surface for radio frequency (RF) signals within a defined frequency band, and when the electrical connection is open the conductive patch presents an electrically conductive surface for RF signals within the defined frequency band.

20 Claims, 11 Drawing Sheets

(56) References Cited

OTHER PUBLICATIONS

Comparison of Circular, Square Cell and Hexagonal Cell Artificial Magnetic Conductors for Broadband Staggered Dipole Arrays with Low Profile, Halim Boutayeb, et al., Mar. 2017, 6 pages.

* cited by examiner

RECONFIGURABLE RADIAL WAVEGUIDES WITH SWITCHABLE ARTIFICIAL MAGNETIC CONDUCTORS

TECHNICAL FIELD

The present disclosure relates to antenna design, and, in particular embodiments, to an apparatus and method for a reconfigurable waveguide antenna array and for a switchable artificial magnetic conductor for use in the waveguide.

BACKGROUND

Radio Frequency (RF) transmitters make use of antennae to propagate wireless RF signals. The shape of the antenna along with RF signal processing techniques can allow for beam steering to be achieved. Beam steering allows for spatial selectivity in the placement of the direction of a main lobe of the radiated signal. Conventional beam steering techniques rely on manipulating the phase of RF signals through a series of phase shifters and RF switches. The inclusion of phase shifters, RF switches, and other complex components increase the manufacturing cost and design complexity of antennas. Existing radial waveguide antenna structures that enable beam steering often rely on configurations that are not space efficient or rely on costly components or assemblies. Accordingly, less complex antenna designs with broadband capabilities are desired. Such antennae could be used in agile deployments.

SUMMARY OF THE INVENTION

The present disclosure describes a switchable artificial magnetic conductor (S-AMC) as well as agile antenna devices that incorporate an array of S-AMCs to beam steer wireless transmissions. In at least some applications the S-AMCs and antenna devices that are described can be used to implement space-efficient antenna structures that are more cost effective to produce than conventional beam steering antennas.

According to a first example aspect is a switchable artificial magnetic conductor (S-AMC) element that includes a conductive layer, a conductive patch located on one side of the conductive layer and electrically isolated from the conductive layer, and an open stub located on an opposite side of the conductive layer and electrically isolated from the conductive layer. A switch element is configured to selectively open and close an electrical connection between the conductive patch and the open stub in response to a control signal. When the electrical connection is closed the conductive patch presents a high impedance, magnetically conductive surface for radio frequency (RF) signals within a defined frequency band, and when the electrical connection is open the conductive patch presents an electrically conductive surface for RF signals within the defined frequency band.

In some examples, the open stub and the conductive patch are configured to function as an LC circuit having a resonant frequency that falls within the defined frequency band when the electrical connection is closed. In some examples, the switch element is one of a switchable diode and a nano-electromechanical switch (NEMS).

In some examples, the S-AMC element is formed from a multilayer structure that includes the conductive layer as an intermediate layer sandwiched between first and second dielectric substrate layers, the conductive patch being located on the first dielectric substrate layer and the switch element and open stub being located on the second dielectric substrate layer, the S-AMC element including a conductive element that extends from the conductive patch through the first dielectric layer, the conductive layer and the second dielectric layer to the switch element.

In an example implementation, a plurality of the S-AMC elements of the first example aspect can be incorporated into a plate of a parallel plate waveguide, the plurality of S-AMC elements being configured to present, when in a first state, a magnetically conductive surface for RF signals within a target frequency band that includes the defined frequency band, and, when in a second state, an electrically conductive surface for the RF signals within the target frequency band, thereby controlling a propagation direction of the RF signals within the parallel plate waveguide. In some examples, the parallel plate waveguide is a radial waveguide having an RF feed at a center thereof, and the plurality of S-AMC elements are arranged in a circular array. In some examples, the defined frequency band is different for at least some of the S-AMC elements, the target frequency band for the plurality of S-AMC elements being larger than the defined frequency bands of individual S-AMC elements.

According to a second example aspect is a waveguide that includes opposed first and second plates defining a radio frequency (RF) signal waveguide region between them, the first plate including an array of switchable artificial magnetic conductor (S-AMC) elements, that can each be switched between a first state in which a waveguide surface of the S-AMC element is electrically conductive within a defined frequency band and a second state in which the waveguide surface is magnetically conductive within the defined frequency band. A radio frequency (RF) probe is disposed in the waveguide region for at least one of generating or receiving RF signals. A control circuit is coupled to the S-AMC elements to selectively control the state thereof to control a propagation direction of RF signals within the waveguide region relative to the RF probe.

In some examples of the second example aspect, the waveguide is a radial waveguide, and the array of S-AMC elements is a circular array surrounding the RF probe. In some examples, the S-AMC elements are arranged in a plurality of rings surrounding the RF probe. In some examples, the S-AMC elements are arranged in a plurality of independently controllable arc section groups of the S-AMC elements surrounding the RF probe. In at least some examples, at least some of the S-AMC elements within each arc section group have a different defined frequency band than other S-AMC elements within the arc section group.

According to a third example aspect is a method of beam steering radio frequency (RF) signals using a waveguide structure that includes: a waveguide region between opposed first and second surfaces, a RF probe disposed in the waveguide region and an array of switchable artificial magnetic conductor (S-AMC) elements defining the first surface. Each of the S-AMC elements can be switched between a first state in which the S-AMC element presents an electrically conductive surface to RF signals in the waveguide region within a defined frequency band and a second state in which the S-AMC elements present a magnetically conductive surface to RF signals in the waveguide region within the defined frequency band. The method includes, controlling, with a microcontroller, the states of the S-AMC elements to control a propagation direction of the RF signals within the waveguide region.

BRIEF DESCRIPTION OF THE DRAWINGS

For a more complete understanding of the present invention, and the advantages thereof, reference is now made to the following descriptions taken in conjunction with the accompanying drawing, in which.

Corresponding numerals and symbols in the different FIGS. generally refer to corresponding parts unless otherwise indicated. The FIGs. are drawn to clearly illustrate the relevant aspects of the embodiments and are not necessarily drawn to scale. Terms describing orientation such as top, bottom, front, back, left and right are used in this disclosure as relative terms.

DETAILED DESCRIPTION OF ILLUSTRATIVE EMBODIMENTS

Disclosed herein are example embodiments for a switchable artificial magnetic conductor (S-AMC) as well as an agile antenna device that incorporates an array of S-AMCs to beam steer broadband wireless transmissions. As used herein, the terms radio frequency (RF) and RF signals are used to represent frequencies and signals, respectively, in the regions of the RF spectrum suitable for wireless communications, including but not limited to ultra high frequency (UHF), super high frequency (SHF) and extremely high frequency (EHF) bands.

An AMC, also known as a high-impedance surface, is a type of artificially engineered material with a surface equivalent to a magnetic conductor at a specific frequency band. AMC structures are typically implemented using periodic structures printed in dielectric substrates with various metallization patterns. Among their properties, AMC surfaces are two that have led to a wide range of microwave circuit applications. The first property is that AMC surfaces have a forbidden frequency band. Waves within the forbidden frequency band cannot propagate adjacent the surface and the corresponding current is blocked from propagating along the surface. This makes AMC surfaces useful as ground planes and both planar and waveguide type filters. For example, antenna ground planes that use AMC surfaces can be designed to have good radiation patterns without unwanted ripples. This may be achieved through suppressing the surface wave propagation within the band gap frequency range. The second property is that AMC surfaces have very high surface impedance within a specific limited frequency range. Within this specific limited frequency range, the tangential magnetic field is small, even with a large electric field along the surface. Therefore, an AMC surface can have a reflection coefficient of +1 (in-phase reflection). In practice, the reflection phase of an AMC surface will typically vary continuously from +180° to −180° relative to the frequency, and will cross zero at just one frequency (for one resonant mode). Due to this unusual boundary condition, and in contrast to the case of a conventional metal plane, an AMC surface can function as a ground plane for low-profile wire antennas, which is desirable in many wireless communication systems.

Figure 1:
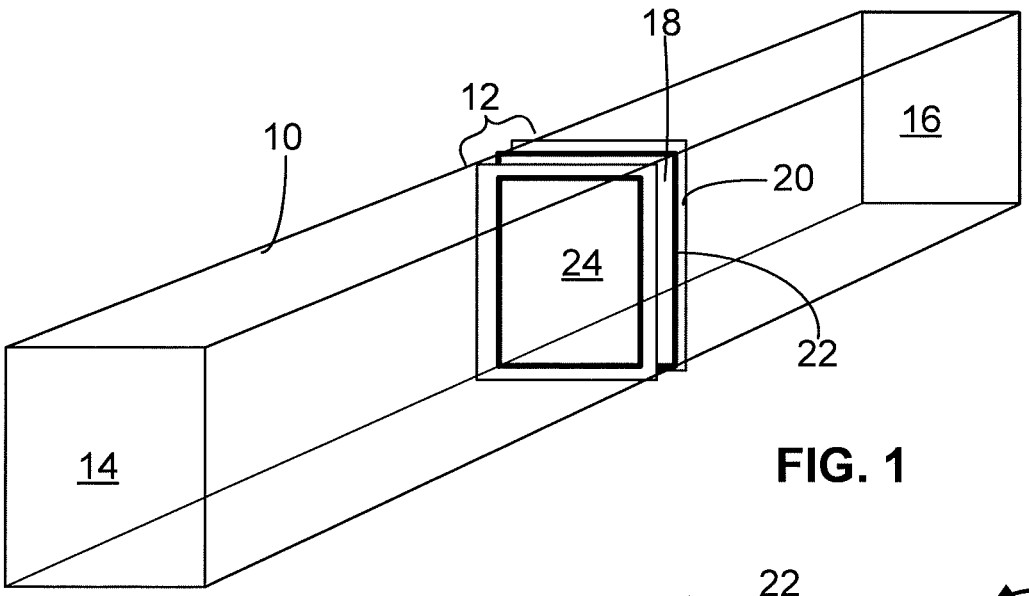
FIG. 1 illustrates an example of a waveguide incorporating a switchable artificial magnetic conductor (S-AMC) element according to an example embodiment.

According to example embodiments, a switchable AMC element is disclosed that can be switched between a magnetic conductor mode and an electrical conductor mode within a defined frequency band. For the purpose of illustrating a switchable AMC element, FIG. 1 shows an example of a rectangular waveguide 10 having an switchable AMC (S-AMC) element 12 positioned across a waveguide passage between a first port 14 and a second port 16 of the waveguide 10.

Figure 2:
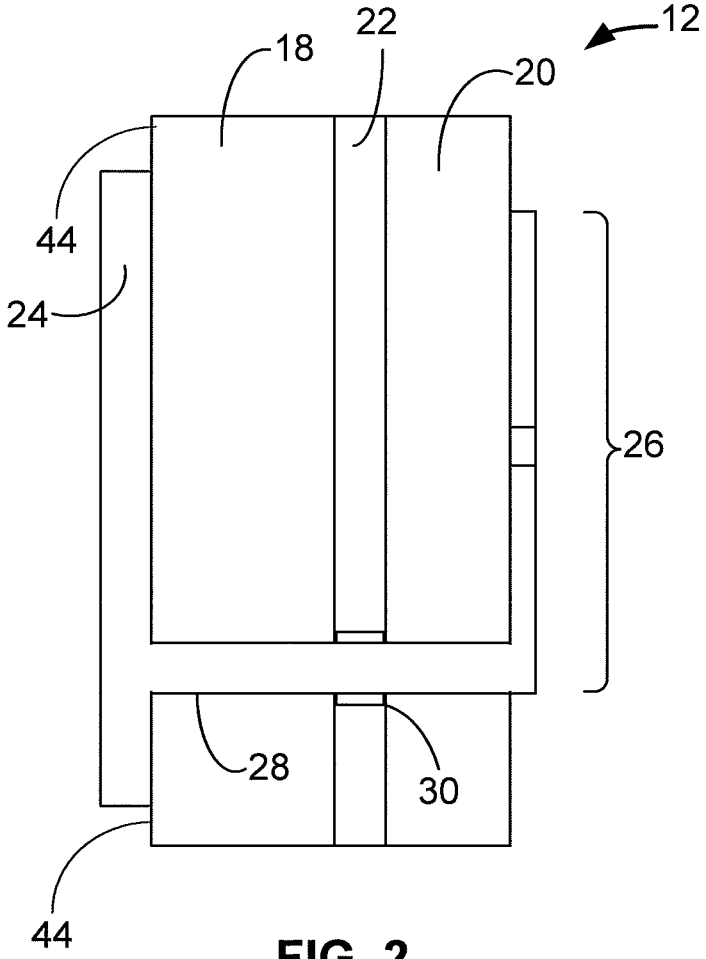
FIG. 2 is a sectional side view of the S-AMC element of the waveguide shown in FIG. 1.

Referring to the side sectional view of FIG. 2, in the illustrated example, S-AMC element 12 is formed from a multilayer printed circuit board (PCB) that comprises a first dielectric substrate layer 18 and a second dielectric substrate layer 20 on opposite sides of an intermediate ground conductive layer 22. A conductive patch 24 is located on an outer surface of the first dielectric substrate layer 18, and an active element 26 is located on an outer surface second dielectric substrate layer 20. The conductive patch 24 is surrounded by an insulating gap 44. A conductive element 28, which may for example be a metallic via or pin, extends through the first and second substrate layers 18, 20 and intermediate ground conductive layer 22 to electrically connect patch 24 to an end of the active element 26. Conductive element 28 extends through an opening 30 provided through ground conductive layer 22 that electrically isolates the conductive element 28 from the ground conductive layer 22.

Figure 3:
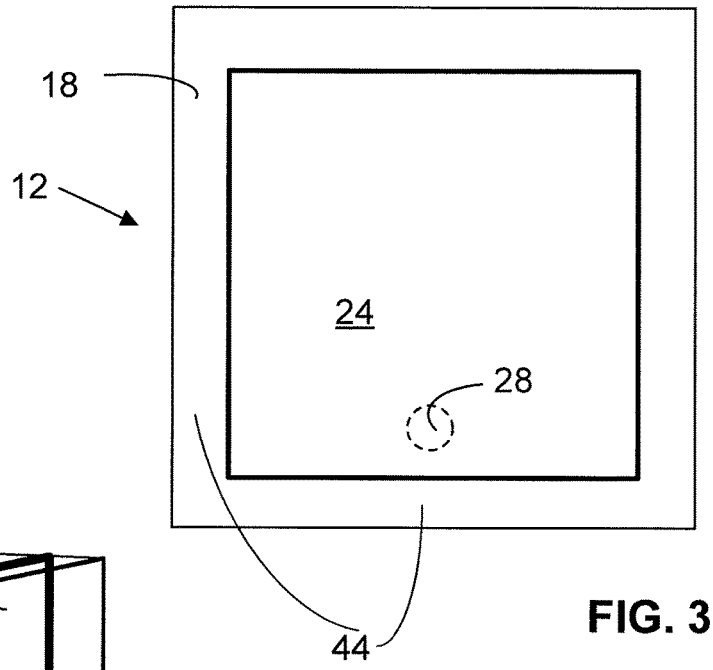
FIG. 3 is a front view of the S-AMC element of FIG. 2.
Figure 4:
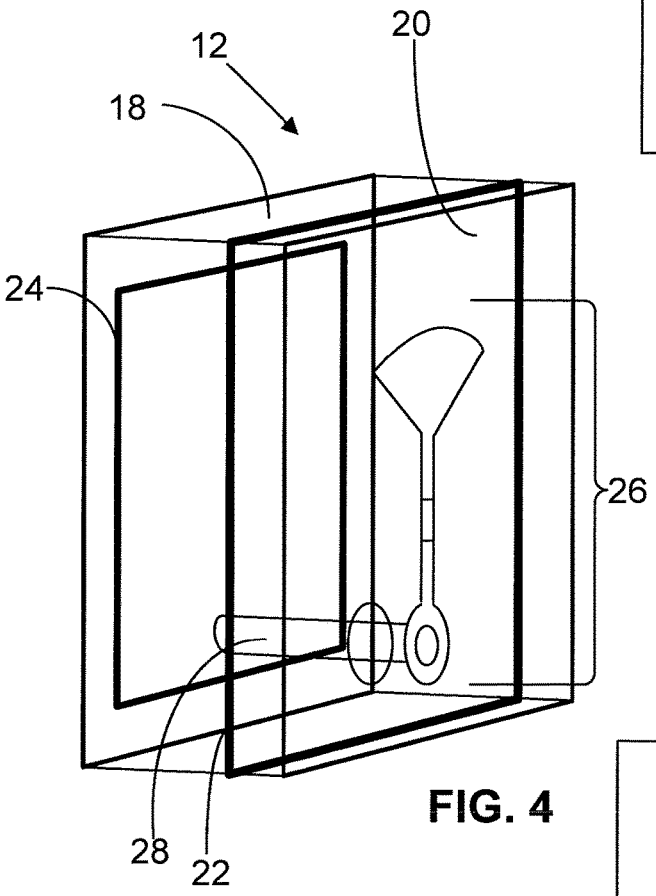
FIG. 4 is a wireframe perspective view of the S-AMC element of FIG. 2.
Figure 5:
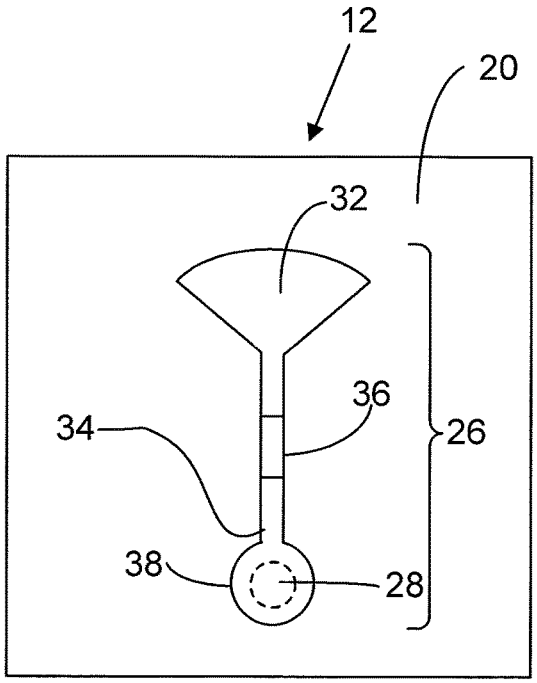
FIG. 5 is a back view of the S-AMC element of FIG. 2.

FIGS. 3 to 5 show front, perspective and back views of the S-AMC element 12 respectively. As noted above, conductive element 28 is electrically connected to one end 38 of the active element 26. At its opposite end, the active element 26 includes a radial open stub 32, formed by a conductive layer on the outer surface of the substrate layer 20. The radial open stub 32 presents a certain impedance within a defined frequency band. The conductive element 28 is electrically connected by a conductive microstrip line 34 to the radial open stub 32 through a switch element 36 such as a PIN diode or a nano-electromechanical (NEM) switch. The switch element 36 can be controlled by a control signal to selectively connect and disconnect the conductive element 28 (and thus conductive patch 24) to the radial open stub 32.

The active element 26 can be used to control the behaviour of the S-AMC element 12 depending on whether the switch element 36 is "ON" or "OFF". When switch element 36 is "ON", it electrically connects conductive patch 24 to the radial open stub 32. When the switch element 36 is "OFF" it electrically isolates the conductive patch 24 from the radial open stub 32. When the switch element 36 is OFF, the S-AMC behaves as an electrical conductor within the defined frequency band. When the switch element 36 is ON, the S-AMC behaves as a magnetic conductor within the defined frequency band. This change of behaviour is due to the change of the equivalent capacitance and the equivalent inductance of the S-AMC element 12, which determines the surface impedance presented by the S-AMC element 12 within the defined frequency band. In particular, the S-AMC element 12 behaves as an inductive/capacitive (LC) resonator that functions as a magnetic conductor at a resonant frequency. The resonate frequency at which the S-AMC element 12 functions as a magnetic conductor is dependent on the equivalent capacitance or the equivalent inductance (or both). This in turn is dependent on the physical dimensions and properties of the components that make up the S-AMC element 12. The resonant frequency, and resulting defined frequency band, are set for the S-AMC element 12 during a design phase of the -AMC element 12 by selecting the appropriate physical dimensions and/or properties of the S-AMC element 12. For a simulated example at 28 GHz ($\lambda_O$=10.7 mm) the following dimensions/properties were used: a substrate layer 18 of thickness 0.5 mm and dielectric constant of 3.7; a substrate layer 20 of thickness 0.2 mm and dielectric constant of 3.7; an S-AMC element 12 unit cell size of 6 mm×6 mm (about $0.56\lambda_O \times 0.56\lambda_O$); a conductive patch 24 size of 5 mm×5 mm (about $0.46\lambda_O \times 0.46\lambda_O$); a microstrip line 34 of width 0.1 mm and length 0.3 mm; and an open radial stub 32 length of 0.9 mm (about $0.15\lambda_g$, where $\lambda_g$ is the wavelength of the 28 GHz signal in the substrate layers).

Figure 6A:
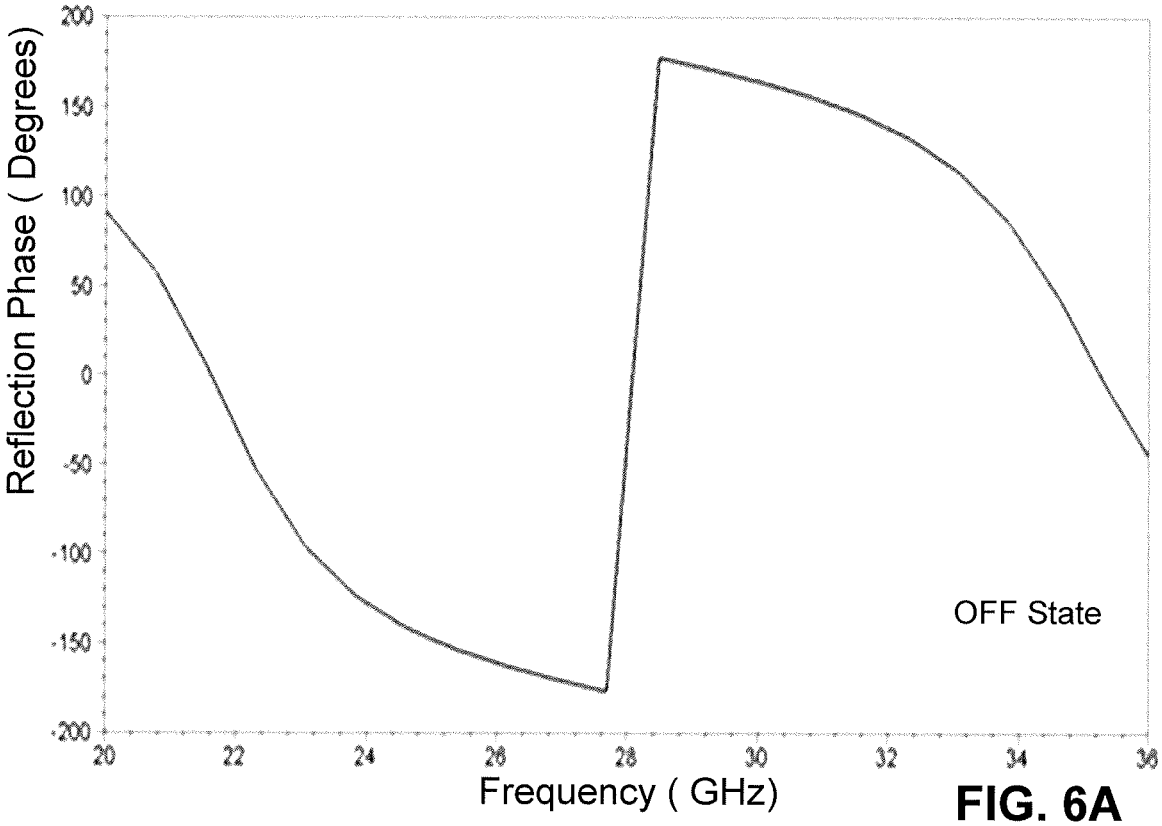
FIG. 6A is a plot representing the reflection coefficient phase for the S-AMC element of FIG. 2 when in an OFF state.
Figure 6B:
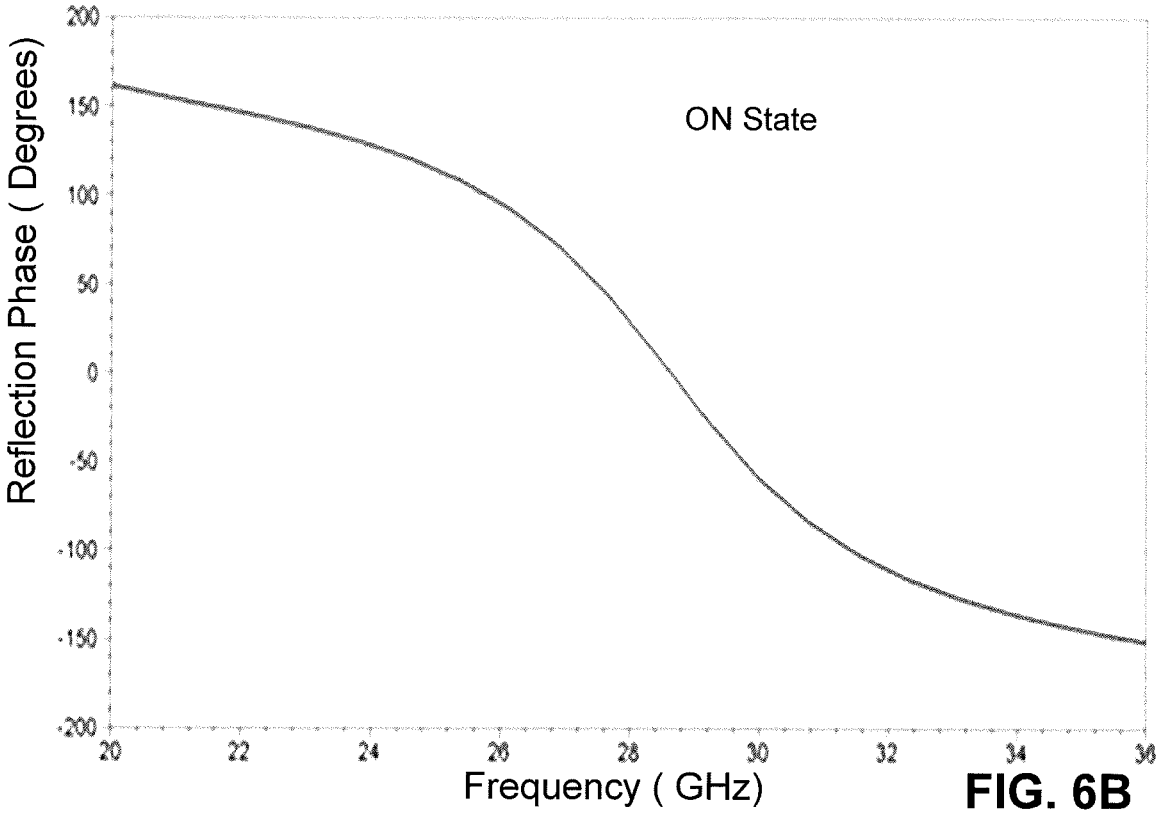
FIG. 6B is a plot representing the reflection coefficient phase for the S-AMC element of FIG. 2 when in an ON state.

The operation of S-AMC element 12 within the illustrative waveguide 10 of FIG. 1 is represented in FIGS. 6 and 7. In particular, the phase of the reflection coefficient of the S-AMC element 12 using Fouquet boundary conditions (at normal incidence), measured at the first port 14, is represented in FIG. 6A for the case where the switch element 36 is OFF, and in FIG. 6B for the case where the switch element 36 is ON. As represented in FIG. 6A, at a frequency of around 28 GHz, the S-AMC element 12 behaves like an electric conductor when in the OFF state, providing a phase reflection coefficient of about +/−180 degrees at 28 GHz. However, as represented in FIG. 6B, at the same frequency of around 28 GHz, the S-AMC element 12 behaves like a magnetic conductor when in the ON state, providing a phase reflection coefficient of about 0 degree. Accordingly, S-AMC element 12 functions as a reconfigurable element that can be configured to, when in a first state (e.g. the OFF state) act as an electric conductor for signals within a defined frequency band and, when in a second state (e.g. the OFF state) act as a high impedance magnetic conductor.

Figure 7A:
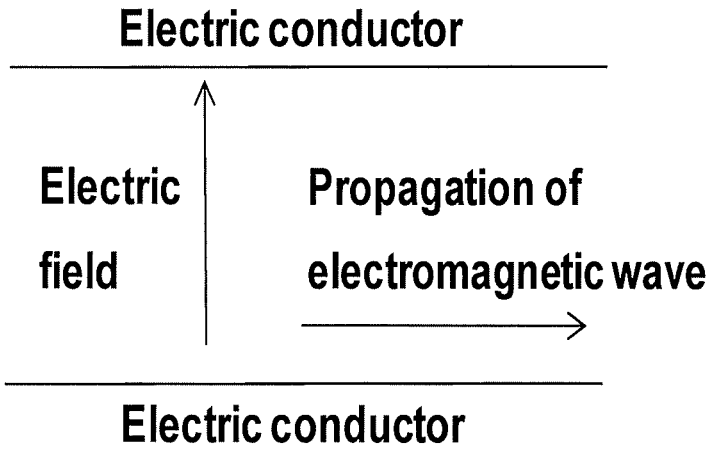
FIG. 7A is a schematic showing directions of an electric field and electromagnetic wave in a parallel conductive plate structure.
Figure 7B:
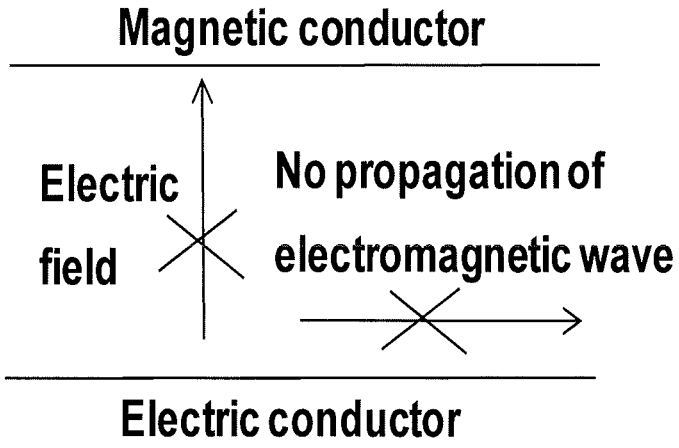
FIG. 7B is a schematic illustrating the absence of an electric field and electromagnetic wave in a parallel plate structure in which one of the plates is a magnetic conductor.

In example embodiments, the reconfigurable behaviour of S-AMC element 12 is used to provide a waveguide structure that can selectively propagate RF signals as electromagnetic (EM) waves. By way of explanation, FIGS. 7A and 7B illustrate structures that respectively propagate and block EM waves. FIG. 7A shows a conventional parallel-plate waveguide structure in which EM waves propagate in a dielectric medium located between two electric conducting plates. The existence of an electric field between the electric conductors enables the EM waves to propagate. FIG. 7B shows the same structure in which the top electrical conductor plate is replaced with a magnetic conductor. The magnetic conductor has a high electrical impedance, with the result that no electrical field exists between the parallel plates and the propagation of EM waves between the plates is blocked.

Figure 8:
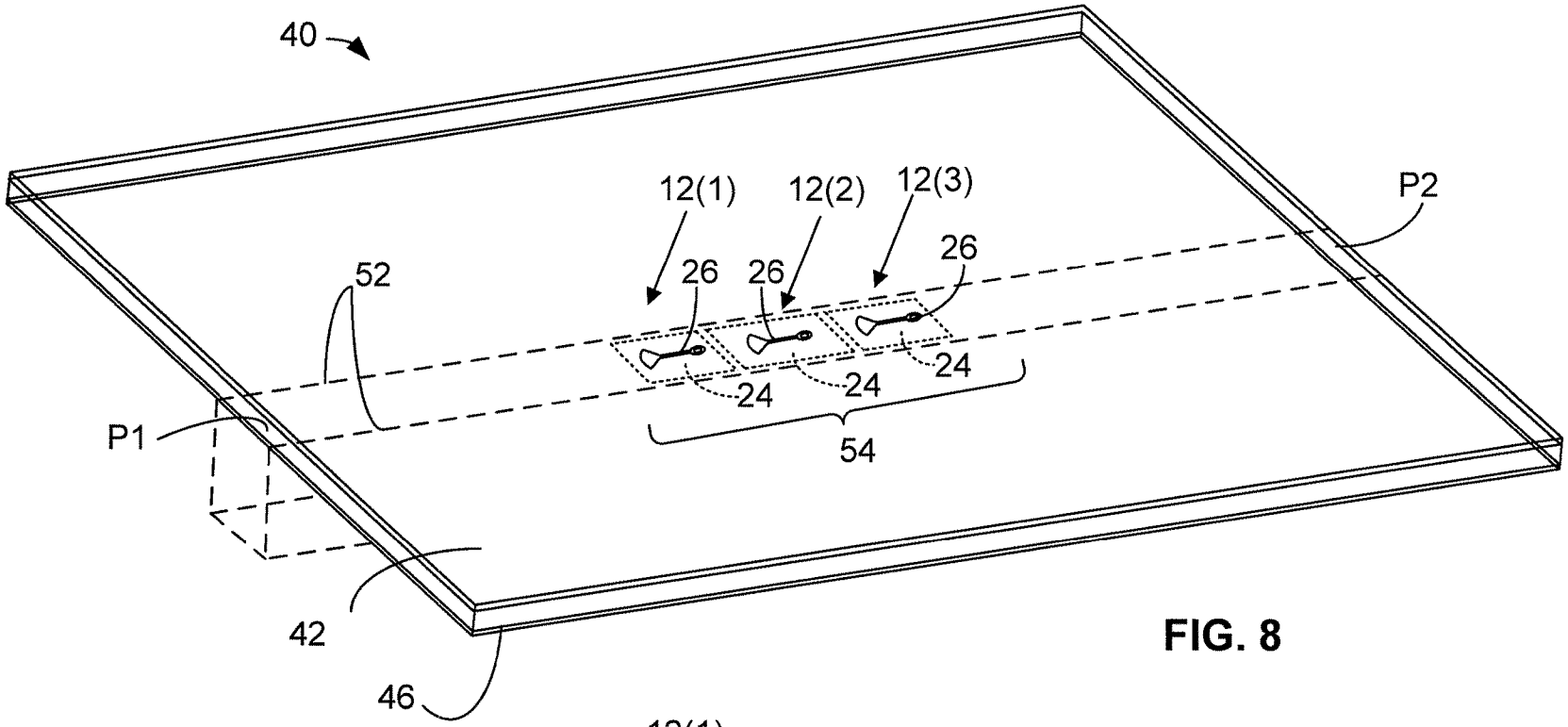
FIG. 8 is a wireframe perspective view of a waveguide having a ground plane printed circuit board (PCB) that incorporates a plurality of the S-AMC elements of FIG. 2.
Figure 9:
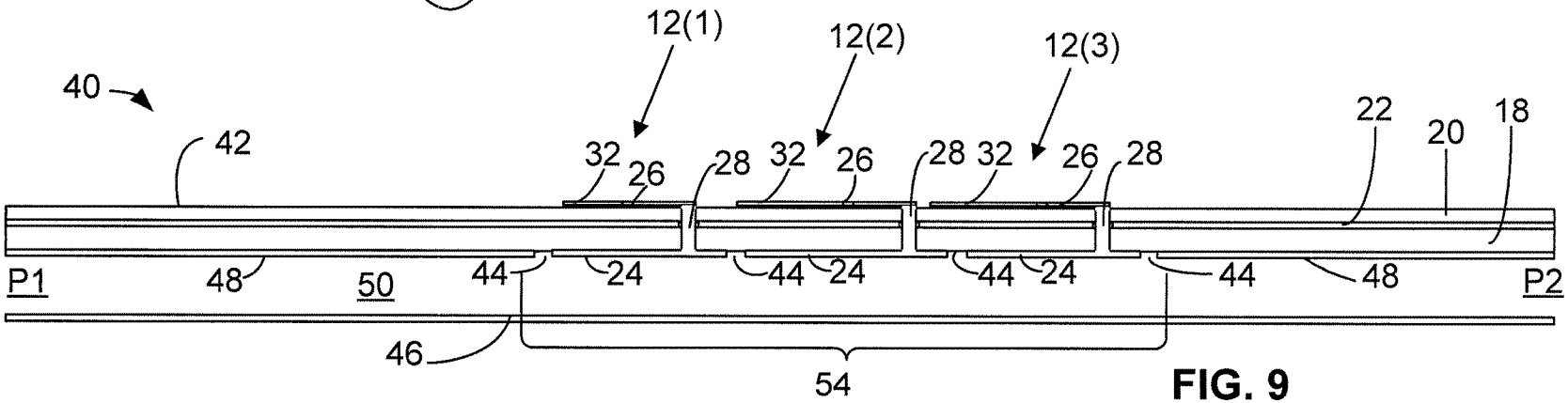
FIG. 9 is a sectional side view of the waveguide of FIG. 8.

Accordingly, in example embodiments, a plurality of S-AMC elements 12 are arranged to form a planar periodic array structure that can be used as a reconfigurable surface or wall in a waveguide structure. For illustrative purposes, FIG. 8 is a schematic wireframe perspective view of a parallel plate rectangular waveguide 40 in which an S-AMC structure 54 is integrated into a ground plane PCB 42 of the waveguide 40. S-AMC structure 54 includes a row of three S-AMC elements 12(1), 12(2) and 12(3). FIG. 9 is a sectional view extending from port P1 to port P2 of the waveguide 40. As seen in FIGS. 8 and 9, the waveguide 40 includes a waveguide passage 50 that is located between the ground plane PCB 42 and a further planar conductive surface 46. The waveguide passage 50 is filled with a dielectric medium (for example air) that extends from port P1 to port P2. The three S-AMC elements 12(1), 12(2) and 12(3) of S-AMC structure 65 are integrated in a row in the ground plane PCB 42, having a width that corresponds to Floquet boundary conditions (which are illustrated by in FIG. 8 by dashed lines 52).

As shown in FIG. 9, planar ground plane PCB 42 comprises a first, inner, dielectric substrate layer 18 and a second, outer dielectric substrate layer 20 on opposite sides of an intermediate ground conductive layer 22. A further inner facing conductive layer 48 is provided on the inner surface of the inner, dielectric substrate layer 18 in spaced opposition to planar conductive surface 46. Inner facing conductive layer 48 and planar conductive surface 46 define opposing surfaces of the waveguide passage 50. The inner facing conductive layer 48 is etched through to substrate layer 18 to provide rectangular isolating gaps 44 that define the electrically isolated conductive patches 24 of the respective S-AMC elements 12(1), 12(2) and 12(3). As note above, each S-AMC element 12(1), 12(2) and 12(3) includes a respective conductive element 28 extending through the substrate layers 18, 22 and intermediate conductive layer 22 to a respective active element 26 that includes a radial open stub 32. Each of the S-AMC elements 12(1), 12(2) and 12(3) can be controlled by a control signal to electrically connect or disconnect its conductive patch 24 to its radial open stub 32.

Thus, in waveguide 40, the S-AMC elements 12(1), 12(2) and 12(3) can be switched between an OFF state in which the conductive patch 24 of each S-AMC element 12(1), 12(2) and 12(3) is disconnected from its respective radial open stub 32, and an ON state in which the conductive patch 24 of each S-AMC element 12(1), 12(2) and 12(3) is electrically connected to its respective radial open stub 32. In the OFF state, the S-AMC elements 12(1), 12(2) and 12(3) function as electrical conductors within a target frequency band with result that the planar ground plane PCB 42 provides an uninterrupted conductive ground surface along the length of the waveguide passage 50, allowing RF signals in the target frequency band to propagate from port P1 to port P2. Conversely, in the ON state, the S-AMC elements 12(1), 12(2) and 12(3) are reconfigured as hi-impedance magnetic conductors within the target frequency band, with result that the conductive surface is interrupted along ground plane PCB 42, preventing RF signals in the target frequency band from propagating from port P1 to port P2.

As noted above, the resonant frequency (and corresponding target frequency band of ($BW_{target}$)) the S-AMC structure 54 is collectively determined by the physical dimensions and properties of each of the S-AMC elements 12(1), 12(2) and 12(3). In at least some example embodiments, each of the S-AMC elements 12(1), 12(2) and 12(3) may be configured to cover different contiguous frequency bands that overlap in order to provide a larger collective target frequency bandwidth ($BW_{target}$) for the S-AMC structure 54. For example, the radial open stub 32 of each the S-AMC elements 12(1), 12(2) and 12(3) may have different dimensions than the other S-AMC elements. This can be done to target different defined frequency bands within target frequency band $BW_{target}$.

Figure 10:
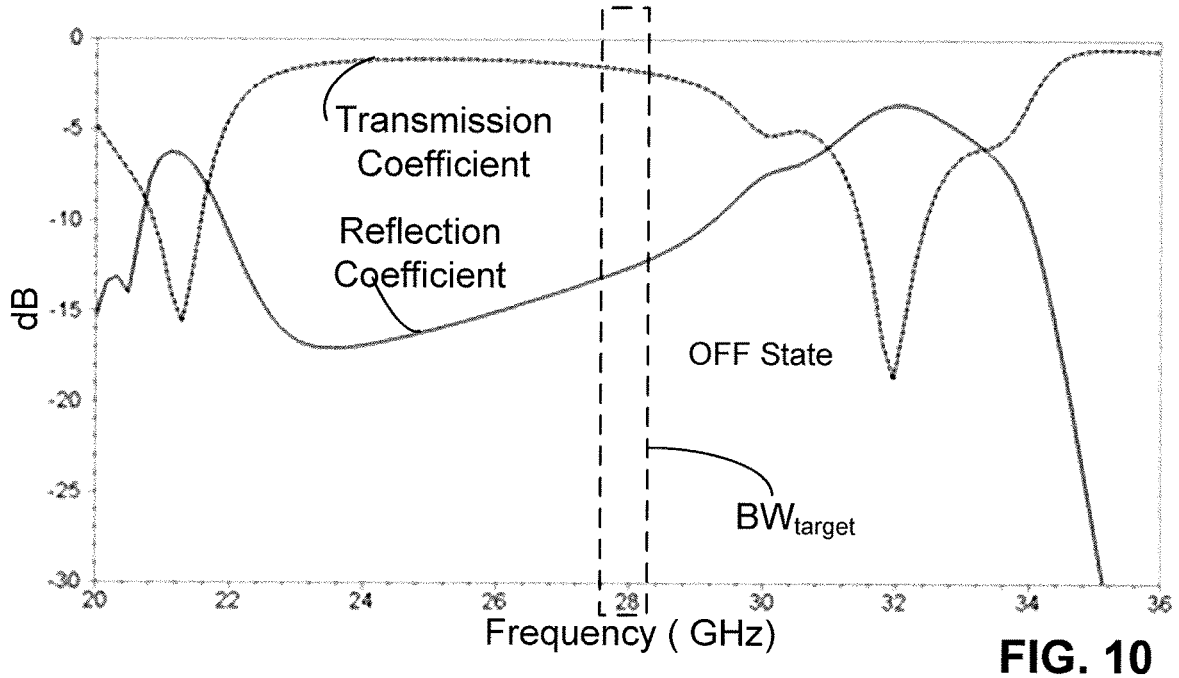
FIG. 10 is a plot representing transmission and reflection coefficients for the waveguide of FIG. 8 when the S-AMC elements are in an OFF state.
Figure 11:
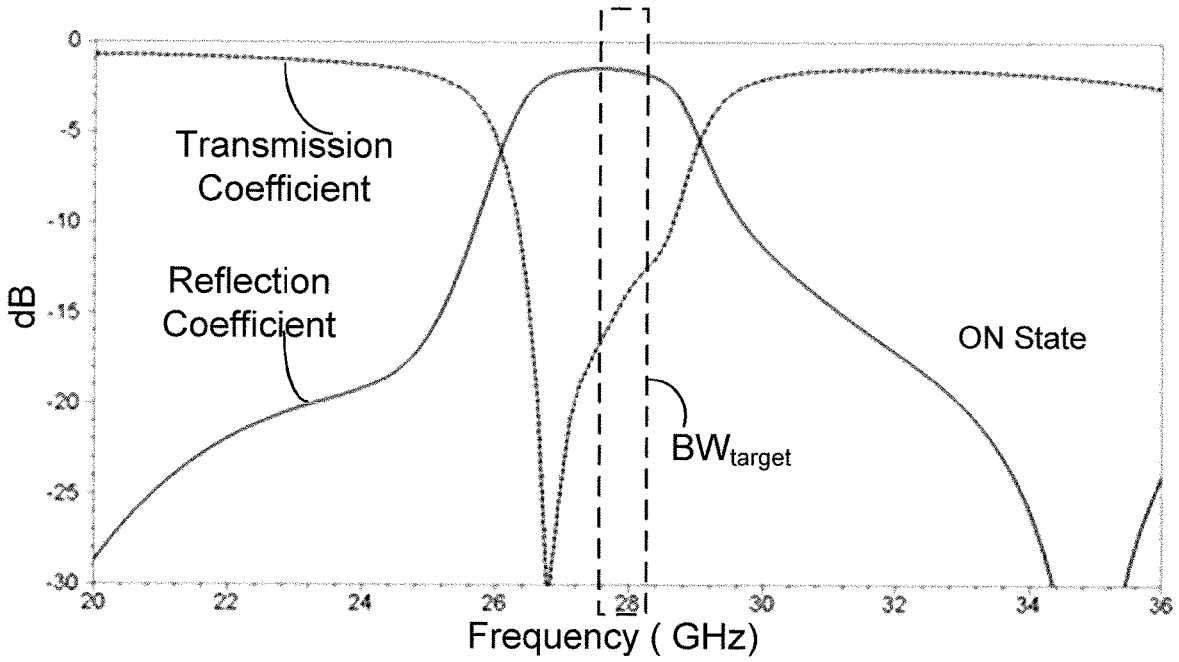
FIG. 11 is a plot representing transmission and reflection coefficients for the waveguide of FIG. 8 when the S-AMC elements are in an ON state.

The operation of S-AMC structure 54 within the illustrative waveguide 40 of FIGS. 8 and 9 is represented in FIGS. 10 and 11. In FIGS. 10 and 11, the transmission coefficient (i.e. RF signal strength received at port P2 relative to signal strength transmitted at port P1) in decibels (dB) is plotted against frequency by the line labelled "transmission coefficient" and the reflection coefficient (i.e. reflected RF signal strength at port P1 relative to the signal transmitted at port P1) is plotted against frequency by the line labelled "reflection coefficient". As shown in FIG. 10, at the target frequency bandwidth of around 28 GHz, when the S-AMC ($BW_{target}$) structure 54 is in an "OFF" state, the transmission coefficient has a high value, and the reflection coefficient has a low value, indicating the S-AMC structure 54 acts as an electrically conductive surface. Conversely, as shown in FIG. 11, when the S-AMC structure 54 is in an "ON" state, the transmission coefficient has a low value, and the reflection coefficient has a high value, indicating the S-AMC structure 54 acts as a high impedance magnetically conductive surface at the target frequency bandwidth ($BW_{target}$) of around 28 GHz.

Figure 12:
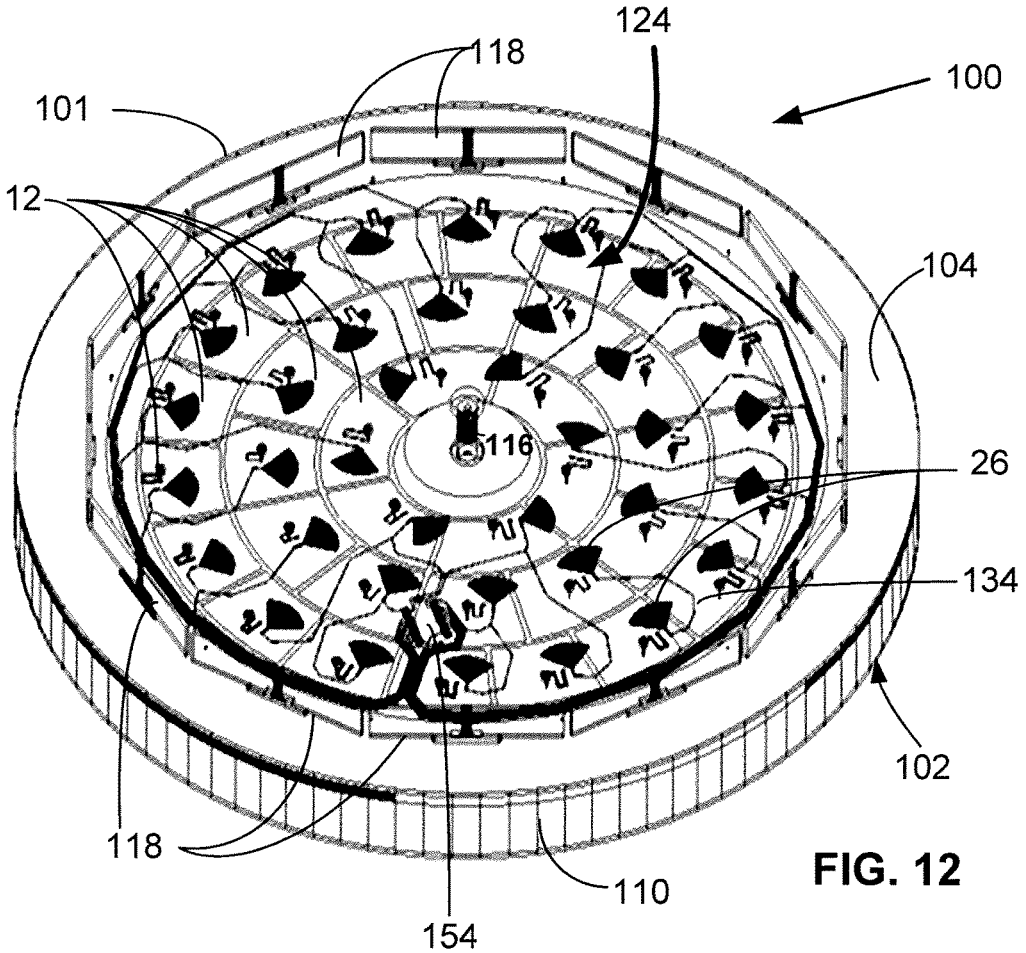
FIG. 12 is a wireframe perspective view of an antenna with a reconfigurable radial waveguide that incorporates S-AMC elements in accordance with example embodiments.
Figure 13:
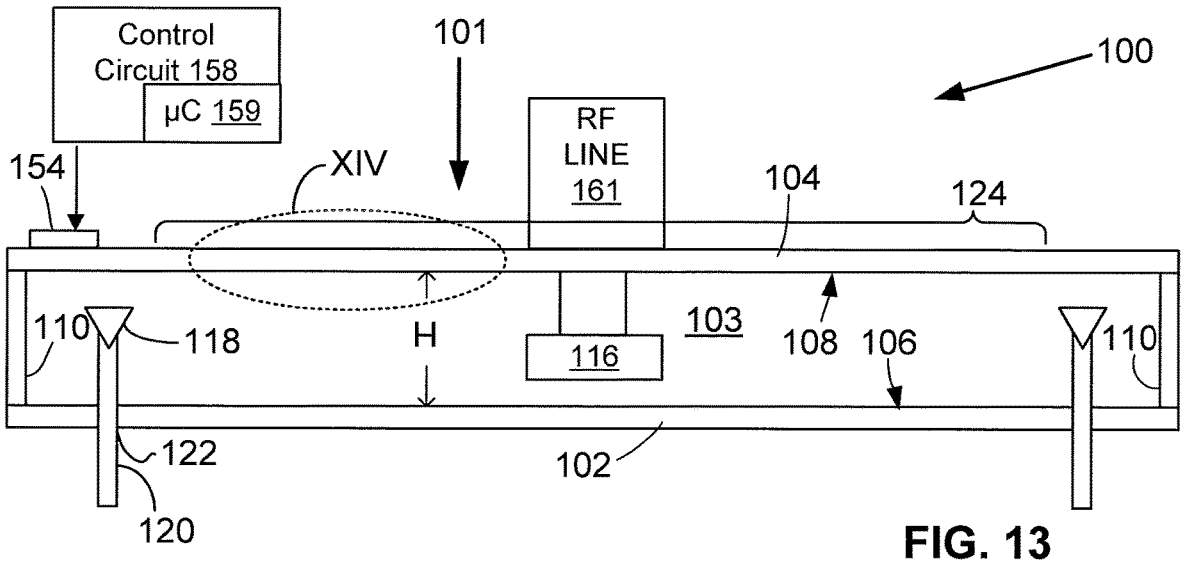
FIG. 13 is a sectional side view of the radial waveguide of FIG. 12.

In example embodiments, the configurable nature of an S-AMC structure that incorporate S-AMC elements 12 is exploited to implement agile beamforming radial waveguide structures. In this regard, FIGS. 12 and 13 show perspective and sectional views, respectively of an antenna 100 according to example embodiments. The antenna 100 includes a reconfigurable radial waveguide structure 101 composed of first and second parallel circular plates 102, 104 that have opposed, spaced apart surfaces 106, 108 (see FIG. 13) that define an internal waveguide region 103. The parallel plates 102, 104 are electrically connected to each other about their respective perimeters by one or more conductive members that form a conductive gasket 110 that provides a short circuit termination. In an embodiment, the conductive gasket 110 is a circumferential conductive gasket placed near the outer edges of both plates 102, 104. The opposed surfaces 106, 108 of parallel plates 102, 104 are separated by a predetermined height, H, that promotes broadband operation. In an example embodiment, the plates 102, 104 are separated by a non-conductive RF permeable medium, which in the illustrated example is air.

In an example embodiment, the bottom circular plate 102 of the radial waveguide structure is formed from a multilayer PCB that includes a central dielectric substrate layer coated with a conductive layer on each of it inner surface 106, outer surface and side edges. In some examples, a set of discrete probes 118 are circumferentially arranged between the parallel plates 102, 104. The probes 118 are each connected to a respective radiating element 120 that extends through a respective slot 122 provided through the circular plate 102. The probes 118 provide a transition for EM waves between the radial waveguide structure 101 and the respective radiating elements 120, such that each of the probes 118 functions as a respective circumferential port to the waveguide structure 101. In some example, probes 118 and radiating elements 120 may be omitted, and the slots 122 configured as radiating slots that function as ports between the radial waveguide structure 101 and the external environment.

Figure 14:
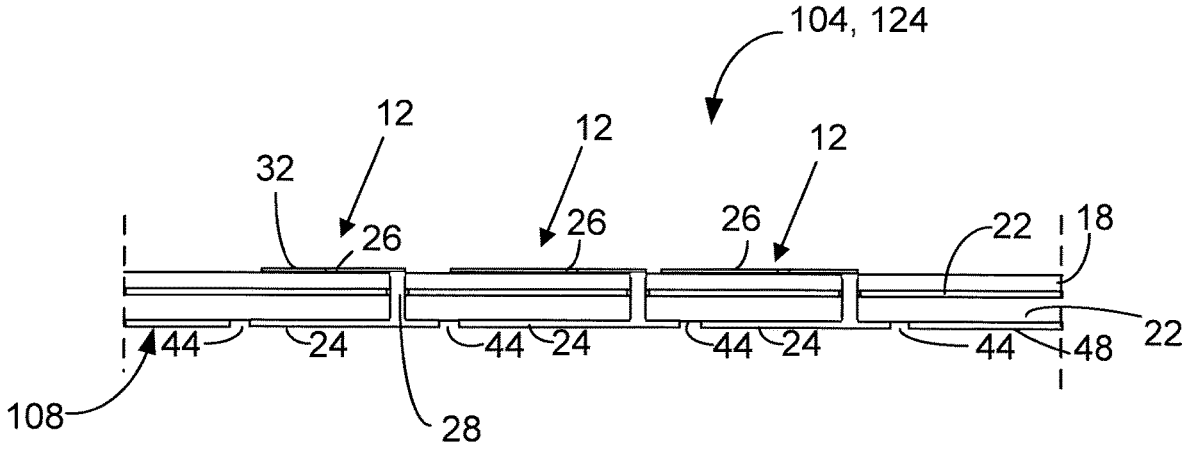
FIG. 14 is an enlargement of the portion XIV of FIG. 3, showing a portion of an S-AMC structure of the radial waveguide of FIG. 12.

The top circular plate 104 is a multilayer PCB that integrates a circular S-AMC structure 124 that includes a circular array of S-AMC elements 12. The top circular plate 104 and integrated S-AMC structure 124 have a similar architecture to that of the ground plane PCB 42 and integrated S-AMC structure 54 discussed above in respect of the waveguide 40 of FIGS. 8 and 9. In this regard, as shown in the enlarged portion shown in FIG. 14, and the top and bottom views of FIGS. 15 and 16, the circular plate 104 includes a first, inner, dielectric substrate layer 18 and a second, outer dielectric substrate layer 20 on opposite sides of intermediate conductive layer 22. Inner facing conductive layer 48 is provided on the inner surface of the dielectric substrate layer 18, defining the top inner surface 108 of waveguide 101. The inner facing conductive layer 48 is etched through to substrate layer 18 to provide isolating gaps 44 that define the electrically isolated conductive patches 24 of the respective S-AMC elements 12. As previously indicated, each S-AMC element 12 includes a respective conductive element 28 extending through the substrate layers 18, 22 and intermediate conductive layer 22 to a respective active element 26 that includes a radial open stub 32.

Figure 15:
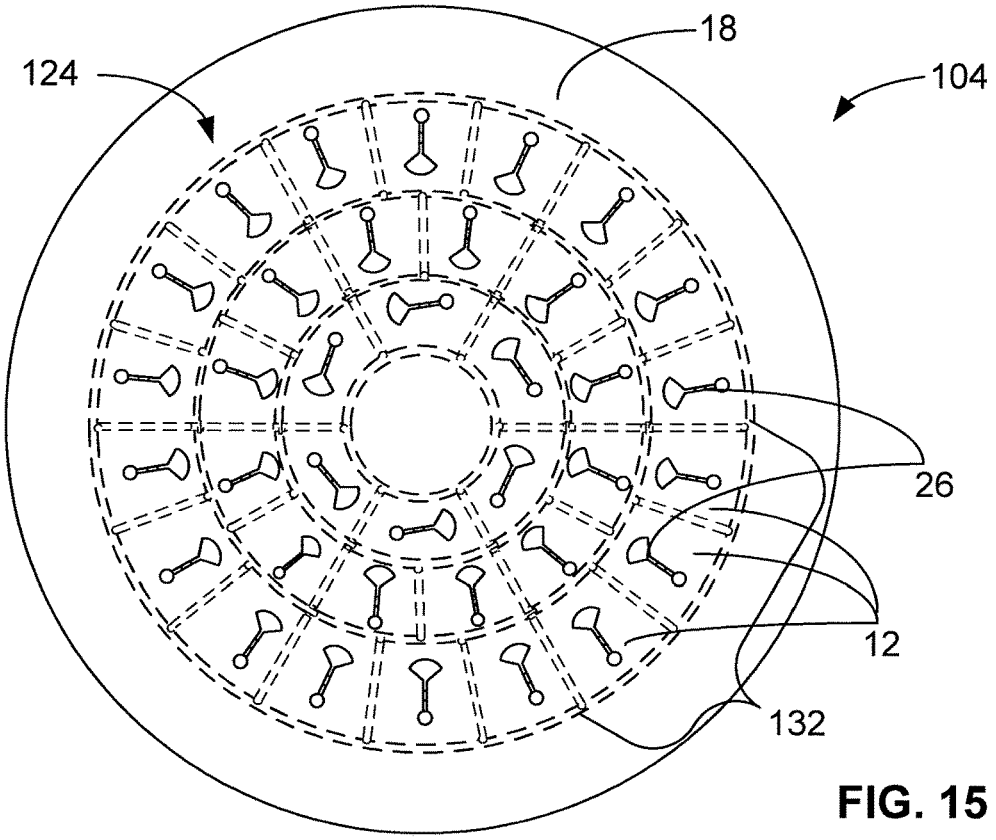
FIG. 15 is a top view of a an S-AMC plate of the radial waveguide of FIG. 12.
Figure 16:
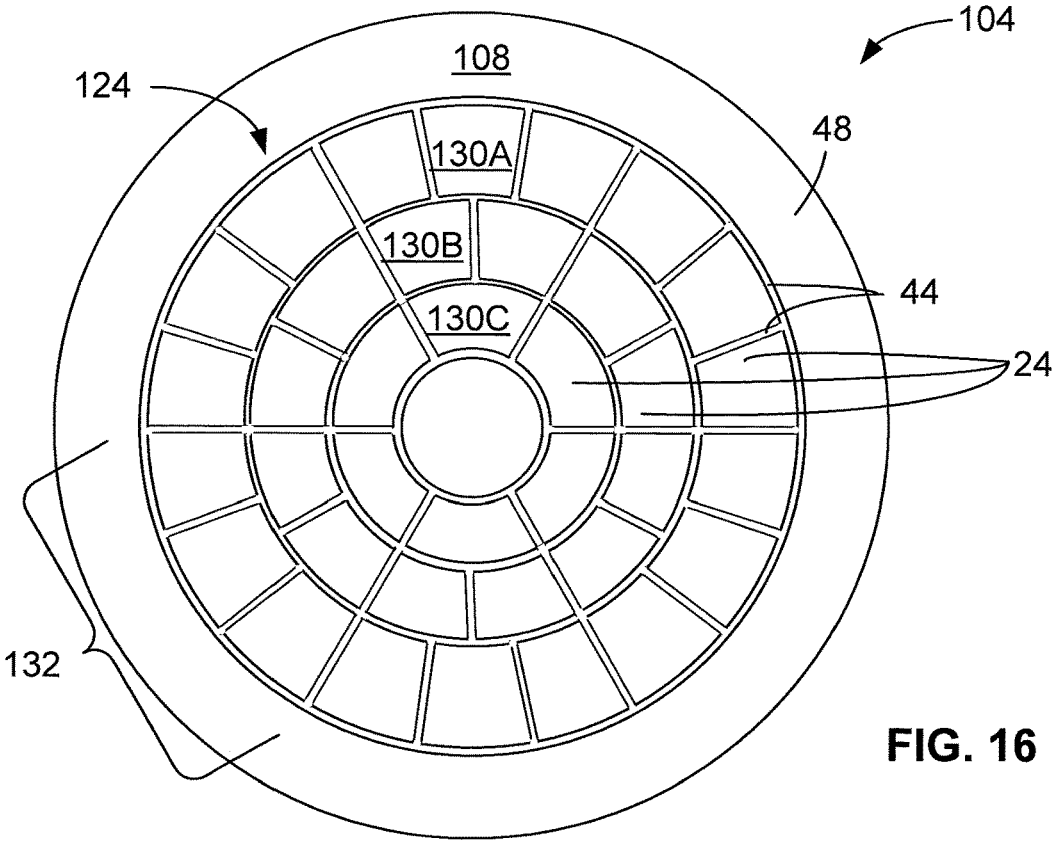
FIG. 16 is a bottom view of the S-AMC plate of FIG. 12.

As can be seen in FIGS. 15 and 16, the S-AMC elements 12 (and their respective the conductive patches 24) are arranged in concentric rings 130A, 103B, 130C on the waveguide surface 108 around a center of the top circular plate 104. Although the number of rings and the number of S-AMC elements 12 in each ring can vary in different configurations and embodiments, in the illustrated embodiment the number of concentric rings is three, with outer ring 130A including eighteen periodically spaced S-AMC elements 12, the middle ring 130B having twelve periodically spaced S-AMC elements 12, and the inner ring 130C having six periodically spaced S-AMC elements 12. In the illustrated example, the S-AMC elements 12 are sectioned into six periodic arc sections 132 that each include six S-AMC elements 12. One of these arc sections 132 is indicated by a bracket in FIGS. 15 and 16.

As seen in the illustrative embodiments of FIGS. 12 and 13, an RF feed or probe 116 can be located at the center of the antenna 100 in the center of the internal waveguide region 103. The central RF probe 116 is electrically isolated from the plates 102, 104 and is connected through an opening in top plate 104 to an RF line connector 161 that allows an RF input and/or output line to be connected to antenna 100. In one example, the connector 161 can be a coaxial interface that connects the RF signal carrying line of a coaxial line to the central RF probe 116 and the grounding sheath of the coaxial line to a common waveguide ground that is coupled to conductive layers of the plates 102. 104 and conductive gasket 110. The circumferential RF probes 118 are located between an outer circumference of the S-AMC structure 124 and the outer conductive gasket 110.

Referring again to FIGS. 12 and 13, in example embodiments, the active elements 26 of the S-AMC elements 12 are each connected to respective control lines 134, which may for example include conductive lines formed on the surface of substrate 18. In the illustrated embodiment, the control lines 134 lead to an interface circuit 154 that may for example include an integrated circuit chip mounted on the plate 104. Referring to FIG. 13, interface circuit 154 is connected to a control circuit 158 that is configured to apply control signals to each of the control lines 134 to selectively control the active elements 26. In example embodiments control circuit 158 comprises a microcontroller 159 that includes a processor and a storage carrying instructions that configure the control circuit 158 to selectively apply different signals to the different control lines 134 in order to achieve beam steering within the radial waveguide 101.

In particular, as described above, when in the OFF state, S-AMC elements 12 will cause a corresponding portion of the waveguide surface 108 to function as a conductive ground plane for RF waves within a target frequency bandwidth ($BW_{target}$) and in the ON state, the S-AMC elements 12 will cause a corresponding portion of the waveguide surface 108 to function as a high impedance magnetic conductor within the target frequency bandwidth.

Figure 17:
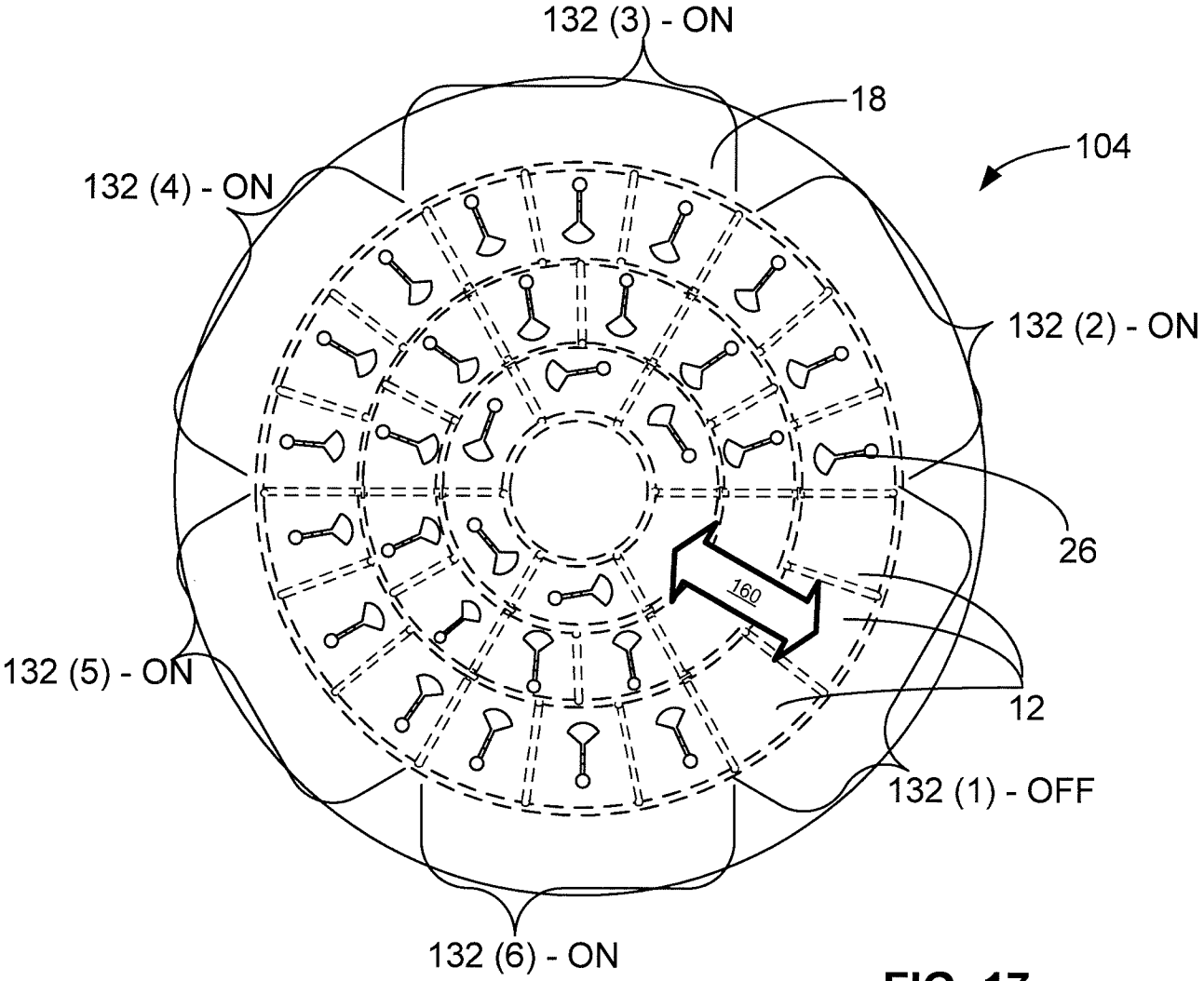
FIG. 17 is a top view of the S-AMC plate of the radial waveguide of FIG. 12, illustrating one operational mode.

From the above description, it will be appreciated that the antenna 200 can be controlled to effect beam steering. In particular, according to an example method, the control circuit 158 can be configured to selectively configure the S-AMC elements 12 for the purpose of directing propagation of RF signals within the radial waveguide region 203 towards selected radial probes 118 that are located in different radial areas of the antenna 100. In some examples, S-AMC elements 12 may be controlled as groups. For illustrative purposes, FIG. 17 is reproduction of FIG. 15 in which each of the six arc segments 132 are respectively labelled as 132(1) to 132(6). In the example of FIG. 17, each of S-AMC elements 12 within an arc segment 132(1) to 132(6) may all be controlled to be in an OFF state or in an ON state as a group. In the particular example illustrated in FIG. 17, all of the active elements 26 in arc segment 132(1) are in an OFF state and all of the active elements in each of the arc segments 132(2) to 132(6) are in an ON state. As a result, the EM waves that correspond to the RF signals are steered within the radial waveguide 101 to propagate only within the arc section 132(1), as indicated buy arrow 160.

In at least some example embodiments, each of the S-AMC elements within a controllable group such as an arc section 132 may be configured to cover different contiguous frequency bands that overlap in order to provide a larger collective target frequency bandwidth ($BW_{target}$) for the arc section 132.

In at least some example embodiments the radial waveguide structure 101 used for antenna 100 may be formed using a structure other than two spaced apart PCB's. For example a multilayer technology such as Low Temperature Co-fired Ceramics (LTCC) may be used to form a suitable structure.

Figure 18:
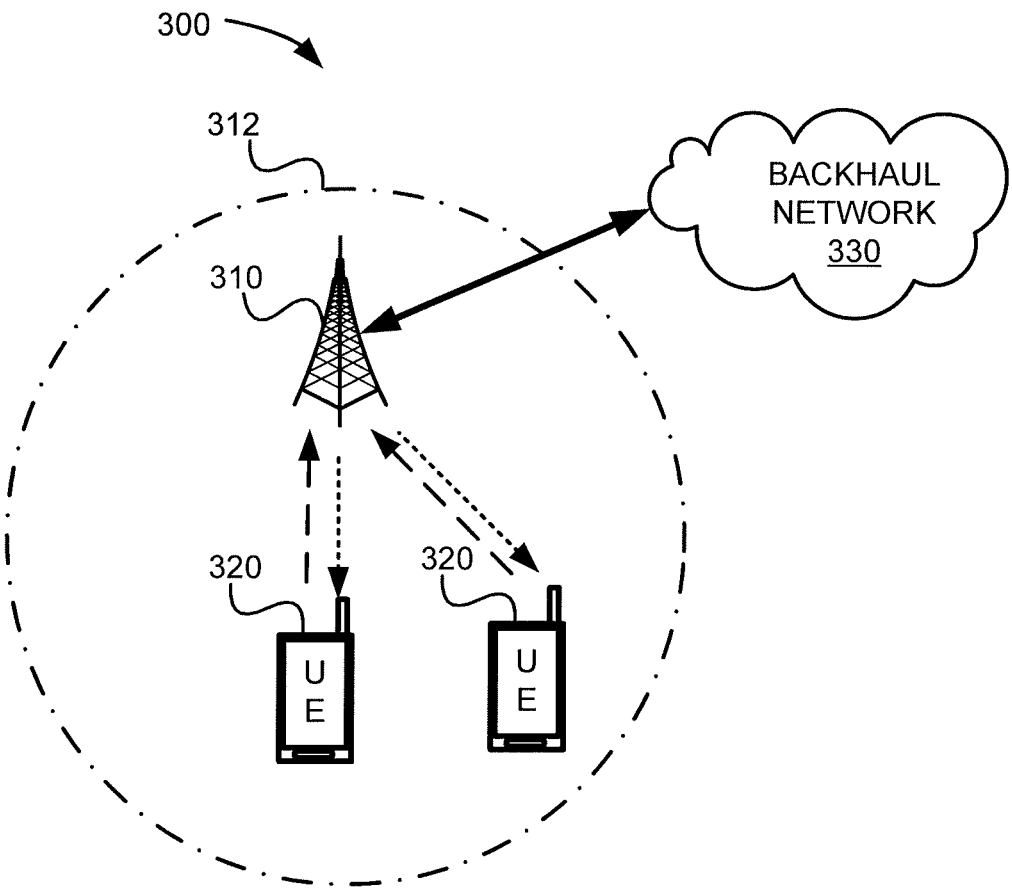
FIG. 18 illustrates a diagram of a wireless network for communicating data.

FIG. 18 illustrates a network 300 in which a beamsteering antenna such as antenna 100 may be used for communicating data. The network 300 comprises a base station 310 having a coverage area 312, a plurality of user equipment devices (UEs) 320, and a backhaul network 330. The base station 310 may comprise any component capable of providing wireless access, e.g., to establish uplink (dashed line) and/or downlink (dotted line) connections with the Ues 320. Examples of the base station 310 include a wireless wide area network base station (nodeB), an enhanced base station (eNB), a next generation NodeB (gNodeB, or gnB), a femtocell, a Wireless LAN or WiFi access point, and other wirelessly enabled devices. The UEs 320 may comprise any components capable of establishing a wireless connection with the base station 310. The backhaul network 330 may be any component or collection of components that allow data to be exchanged between the base station 310 and a remote end (not shown). In some embodiments, the network 300 may comprise various other wireless devices, such as relays, femtocells, etc. The base station 310 or other wireless communication devices of the network 300 may comprise one or more agile antenna devices as described below. The agile antenna devices described above, including for example antenna 100, are used to transmit/receive the wireless or RF signals with the other devices such as for cellular and/or WiFi communications.

Figure 19:
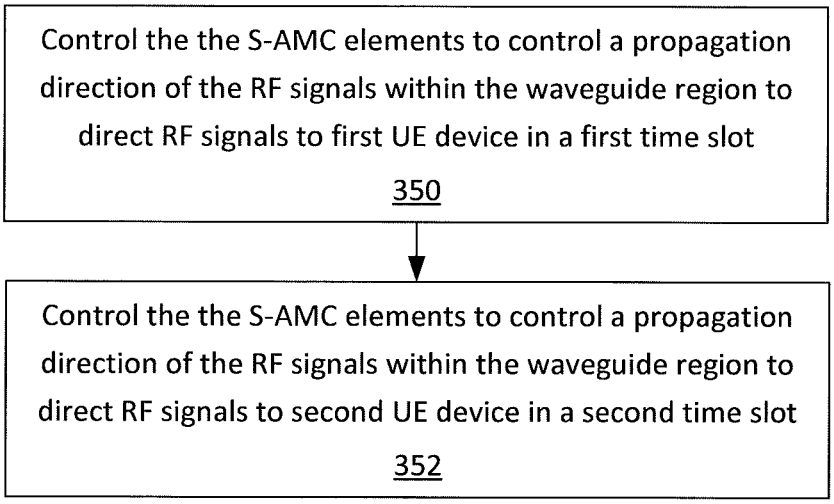
FIG. 19 is a method according to an example embodiment.

FIG. 19 shows an example of a method in which antenna 100 that incorporates radial waveguide 101 may be used in network 300. In the example of FIG. 19, radial waveguide 101 is incorporated into a base station 310 that supports multiple input, multiple output (MIMO) communications with multiple UEs 320. The base station 310 has data to send to a first UE 320 in a first time slot, and to a second UE 320 in a second time slot. As indicated at block 350, the microcontroller 159 of antenna control circuit 158 controls the states of the S-AMC elements 12 of waveguide 101 to control a propagation direction of the RF signals within the waveguide region 103 to transmit a first RF signal to the first UE 320 at a first location in a first timeslot. As indicated at block 352, the microcontroller 159 of antenna control circuit 158 than controls the states of the S-AMC elements 12 of waveguide 101 to control a propagation direction of the RF signals within the waveguide region 103 to transmit a second RF signal to the second UE 320 at a second location in a second timeslot.

Directional references herein such as "front", "rear", "up", "down", "horizontal", "top", "bottom", "side" and the like are used purely for convenience of description and do not limit the scope of the present disclosure. Furthermore, any dimensions provided herein are presented merely by way of an example and unless otherwise specified do not limit the scope of the disclosure.

While several embodiments have been provided in the present disclosure, it should be understood that the disclosed systems and methods might be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted, or not implemented.

In addition, techniques, systems, subsystems, and methods described and illustrated in the various embodiments as discrete or separate may be combined or integrated with other systems, modules, techniques, or methods without departing from the scope of the present disclosure. Other items shown or discussed as coupled or directly coupled or communicating with each other may be indirectly coupled or communicating through some interface, device, or intermediate component whether electrically, mechanically, or otherwise. Other examples of changes, substitutions, and alterations are ascertainable by one skilled in the art and could be made without departing from the spirit and scope disclosed herein.

The invention claimed is:

1. A switchable artificial magnetic conductor (S-AMC) element comprising:

a conductive layer having at least two sides;

a conductive patch located on one side of the conductive layer and electrically isolated from the conductive layer;

an open stub located on an opposite side of the conductive layer and electrically isolated from the conductive layer; and a switch element configured to selectively open and close an electrical connection between the conductive patch and the open stub in response to a control signal, the conductive patch presenting, when the electrical connection is closed, a high impedance, magnetically conductive surface for radio frequency (RF) signals within a defined frequency band, and the conductive patch presenting, when the electrical connection is open, an electrically conductive surface for RF signals within the defined frequency band.

2. The S-AMC element of claim 1 wherein the open stub and the conductive patch are configured to function as an LC circuit having a resonant frequency that falls within the defined frequency band when the electrical connection is closed.

3. The S-AMC element of claim 1 wherein the switch element is one of a switchable diode and a nano-electromechanical switch (NEMS).

4. The S-AMC element of claim 1 wherein the S-AMC element is formed from a multilayer structure that includes the conductive layer as an intermediate layer sandwiched between first and second dielectric substrate layers, the conductive patch being located on the first dielectric substrate layer and the switch element and open stub being located on the second dielectric substrate layer, the S-AMC element including a conductive element that extends from the conductive patch through the first dielectric layer, the conductive layer and the second dielectric layer to the switch element.

5. A plurality of the S-AMC elements of claim 1 incorporated into a plate of a parallel plate waveguide, the plurality of S-AMC elements being configured to present, when in a first state, a magnetically conductive surface for RF signals within a target frequency band that includes the defined frequency band, and, when in a second state, an electrically conductive surface for the RF signals within the target frequency band, thereby controlling a propagation direction of the RF signals within the parallel plate waveguide.

6. The plurality of S-AMC elements of claim 5, wherein the parallel plate waveguide is a radial waveguide having an RF feed at a center thereof, and the plurality of S-AMC elements are arranged in a circular array.

7. The plurality of S-AMC elements of claim 5 wherein the defined frequency band is different for at least some of the S-AMC elements, the target frequency band for the plurality of S-AMC elements being larger than the defined frequency bands of individual S-AMC elements.

8. A waveguide comprising:

opposed first and second plates defining a radio frequency (RF) signal waveguide region between them, the first plate including an array of switchable artificial magnetic conductor (S-AMC) elements, that can each be switched between a first state in which a waveguide surface of the S-AMC element is electrically conductive within a defined frequency band and a second state in which the waveguide surface is magnetically conductive within the defined frequency band;

a radio frequency (RF) probe disposed in the waveguide region for at least one of generating or receiving RF signals; and a control circuit coupled to the S-AMC elements to selectively control the state thereof to control a propagation direction of RF signals within the waveguide region relative to the RF probe.

9. The waveguide of claim 8 wherein the waveguide is a radial waveguide, and the array of S-AMC elements is a circular array surrounding the RF probe.

10. The waveguide of claim 9 wherein the S-AMC elements are arranged in a plurality of rings surrounding the RF probe.

11. The waveguide of claim 9 wherein the S-AMC elements are arranged in a plurality of independently controllable arc section groups of the S-AMC elements surrounding the RF probe.

12. The waveguide of claim 11 wherein at least some of the S-AMC elements within each arc section group have a different defined frequency band than other S-AMC elements within the arc section group.

13. The waveguide of claim 8 wherein each S-AMC element comprises:

a conductive layer;

a conductive patch that defines the waveguide surface and is located on one side of the conductive layer and electrically isolated from the conductive layer;

an open stub located on an opposite side of the conductive layer and electrically isolated from the conductive layer; and a switch element configured to selectively, based on control signals from the control circuit, open an electrical connection between the conductive patch and the open stub to place the S-AMC element in the first state, and close the electrical connection to place the S-AMC element in the second state.

14. The waveguide of claim 13 wherein, for each of the S-AMC elements, the open stub and the conductive patch are configured to function as an LC circuit having a resonant frequency that falls within the defined frequency band when the electrical connection is closed.

15. The waveguide of claim 14 wherein the switch element is one of a switchable diode and a nano-electromechanical switch (NEMS).

16. The waveguide of claim 13 wherein the first plate is a multilayer structure, wherein the conductive layer of the S-AMC elements is an intermediate layer of the first plate sandwiched between first and second dielectric substrate layers, and for each of the S-AMC elements: the conductive patch is located on the first dielectric substrate layer and the switch element and open stub is located on the second dielectric substrate layer, and a conductive element extends from the conductive patch through the first dielectric layer, the conductive layer and the second dielectric layer to the switch element.

17. A method of beam steering radio frequency (RF) signals using a waveguide structure that includes: a waveguide region between opposed first and second surfaces; a RF probe disposed in the waveguide region; an array of switchable artificial magnetic conductor (S-AMC) elements defining the first surface, wherein each of the S-AMC elements can be switched between a first state in which the S-AMC element presents an electrically conductive surface to RF signals in the waveguide region within a defined frequency band and a second state in which the S-AMC elements present a magnetically conductive surface to RF signals in the waveguide region within the defined frequency band;

the method comprising, controlling, with a microcontroller, the states of the S-AMC elements to control a propagation direction of the RF signals within the waveguide region.

18. The method of claim 17 wherein the waveguide is a radial waveguide having the RF probe disposed at a center thereof, the array of S-AMC elements being a circular array surrounding the RF probe, wherein controlling the states of the S-AMC elements comprises controlling the states for groups of the S-AMC elements to propagate the RF signals within a selected arc section of the waveguide.

19. The method of claim 18 wherein within a group of the S-AMC elements, at least some the S-AMC elements have different defined frequency bands.

20. The method of claim 18 wherein controlling the states of the S-AMC elements to control the propagation direction of the RF signals comprises, in a first timeslot, controlling the propagation direction to transmit a first RF signal to a first user equipment at a first location and in a second timeslot, controlling the propagation direction to transmit a second RF signal to a second user equipment at a second location.

* * * * *